United States Patent [19]

Krumholz

[11] Patent Number: 4,762,319

[45] Date of Patent: Aug. 9, 1988

[54] CONVERTIBLE SPORTS STAND CONSTRUCTION

[76] Inventor: Jerrold J. Krumholz, 200 Burnet Ave., Maplewood, N.J. 07040

[21] Appl. No.: 68,964

[22] Filed: Jul. 1, 1987

[51] Int. Cl.[4] ..... A63B 63/08

[52] U.S. Cl. ..... 273/1.5 R; 273/55 R; 273/400; 273/402; 273/410

[58] Field of Search ..... 273/1.5, 55 R, 55 D, 273/398–402, 410, 29 BB

[56] References Cited

U.S. PATENT DOCUMENTS

| | | | |
|---|---|---|---|
| 1,258,931 | 3/1918 | Newcombe | 273/402 |
| 2,533,904 | 12/1950 | Urban | 273/400 X |
| 2,932,516 | 4/1960 | Penner | 273/402 |
| 3,467,388 | 9/1969 | Weiler | 273/400 X |
| 3,602,504 | 8/1971 | Chapman | 273/402 X |
| 3,908,992 | 9/1975 | Cunningham | 273/55 D |
| 4,109,910 | 8/1978 | Gleason | 273/29 BB |
| 4,169,598 | 10/1979 | Taylor | 273/400 |
| 4,592,555 | 6/1986 | Bradford | 273/402 |
| 4,635,943 | 1/1987 | Lumpkin | 273/402 |

FOREIGN PATENT DOCUMENTS

| | | | |
|---|---|---|---|
| 2321436 | 11/1974 | Fed. Rep. of Germany | 273/1.5 R |
| 134485 | 12/1921 | United Kingdom | 273/402 |

*Primary Examiner*—Paul E. Shapiro
*Attorney, Agent, or Firm*—Stefan J. Klauber

[57] ABSTRACT

A multi-purpose sports apparatus has a frame which has spaced-apart support members adapted to rest upon a supporting surface, such as the ground, a net extending between the support members, and a backboard carrying a basketball goal hoop supported between the support members above the net, the backboard being adjustably rotatable horizontally between a vertical position and a horizontal position, whereby the basketball goal hoop can be positioned to extend horizontally or vertically.

12 Claims, 3 Drawing Sheets

CONVERTIBLE SPORTS STAND CONSTRUCTION

FIELD OF THE INVENTION

This invention relates to sports apparatus, and is more particularly concerned with a portable device, which can be used for a plurality of sports activities, particularly by children.

BACKGROUND OF THE INVENTION

In the field of sports apparatus for children especially for practicing sports, utilizing a thrown, batted, or kicked ball, and developing skills in such sports, and which can be employed in the user's backyard or on a playground, there are numerous devices, such as stands with nets, at which a child can throw or bat a ball, or the like, and thus keep the ball retained within his playing area. There are also portable basketball goals available, such as shown in Brumfield, U.S. Pat. No. 3,025,058. May of these devices, however, are usually constructed for a particular, single sports activity, e.g. baseball or basketball, and when a child is interested in practicing or developing his skills in several sports activities over a period of time, or even in a short span, several such individual devices have to be available to him, and carried into place, which is burdensome and difficult, especially if the child is relatively young. Storage and expense are also problems. Some multiple sports devices have been proposed, but they often involve separate, changeable parts which are easily lost when not in use, or some multiple sports apparatus devices have been proposed, which are limited in their utility, or are complicated to use, or have some other disadvantageous feature. Examples of multiple use devices are shown, for example in Broussard, U.S. Pat. No. 4,522,394; and Saytar, U.S. Pat. No. 4,492,380.

The availability of an easily-handled, easily-assembled, easily adjusted, multiple sports apparatus is an important factor in stimulating the development of the child's interest and skill in sports, or in more than one sport. It is important that sports apparatus of this character be capable of being constructed of relatively inexpensive materials, so that it can be made readily available to the average family. These needs have not been satisfied by apparatus which has been proposed to date. There is, therefore, a continuing need for a multi-purpose device that is readily convertible, which can be easily used when desired for various sports activities which are beneficial to developing skills and coordination in the growing child, which can be used both outdoors and indoors, which is of a relatively inexpensive construction, and which can be easily assembled, handled and adjusted.

It is, accordingly, an object of this invention to provide an improved multi-purpose sports apparatus for use by children.

It is a further object of the invention to provide apparatus of the character indicated which is convertible for use with balls associated with different sports.

It is a still further object of the invention to provide sports apparatus for use by children which is of inexpensive construction, is readily portable, can be used for multiple purposes in the sports area, and can be used both outdoors and indoors.

It is another object of the invention to provide a multi-purpose, convertible sports apparatus of the nature specified which is easily assembled, handled and adjusted.

SUMMARY OF THE INVENTION

In accordance with the invention, a multi-purpose convertible sports apparatus comprises a frame having spaced-apart support members adapted to rest upon a supporting surface, such as the ground, net means extending between the support members, and a backboard carrying a basketball goal hoop supported between said support members above said net, the backboard being adjustably rotatable horizontally between a vertical position and a horizontal position, whereby the basketball goal hoop carried by the backboard can be positioned to extend either horizontally or vertically in relation to the supporting surface.

These and other features of the invention will be readily apparent from the following detailed description and from the accompanying drawings.

DESCRIPTION OF THE PREFERRED EMBODIMENTS

Figure 1:
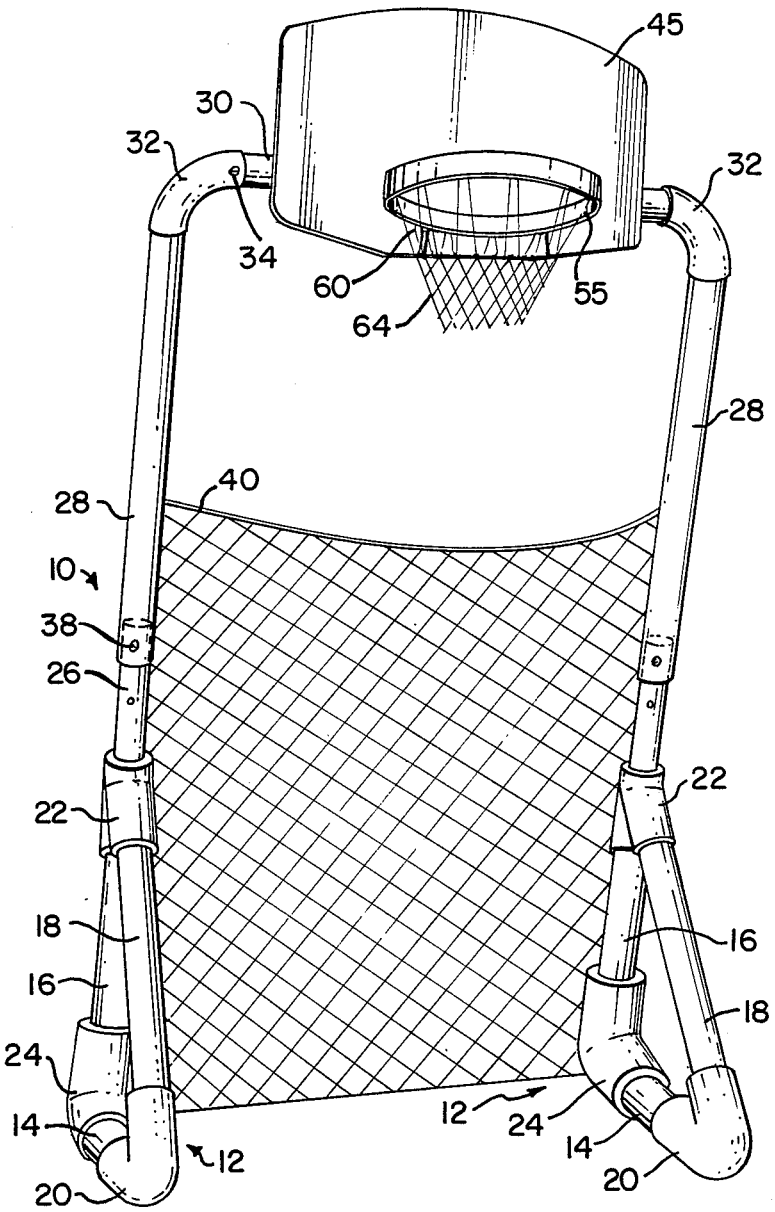
FIG. 1 is a perspective view of a convertible sports unit embodying features of the present invention.

Referring to the drawings, and particularly to FIG. 1, there is shown a convertible, multiple sports apparatus embodying features of the present invention, and indicated generally by the reference numeral 10. Multiple apparatus 10 is defined by two support members 12, each of which is substantially triangular in outline, and has a base 14, a rear leg 16, and a front leg 18, the base 14 and the two legs of each support member being joined together by junction units 20, 22 and 24. All of these parts are suitably hollow and may be formed from any convenient material, such as a molded plastic, e.g. each part may be formed separately and joined to the adjacent part by means of screws or bolts but, most conveniently, parts 14, 16, 18, 20, 22 and 24, are all formed as a unitary structure, e.g. as a single molding. When hollow, the support members 12 can be filled with water or sand to stabilize them, if desired. The enlarged junction units 24 at rear as shown are particularly useful for this purpose. This not only reduces the cost of manufacture, but adds to the strength and rigidity of the support units. Lightness of weight is also achieved by using a plastic.

Figure 4:
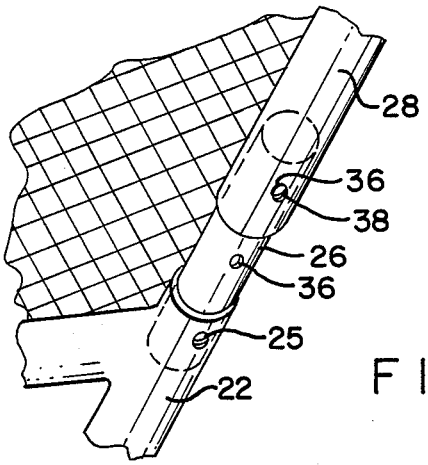
FIG. 4 is an enlarged perspective view, partially broken away, of a portion of the supporting structure shown in FIGS. 1 and 2.

Extending upwardly from junction units 22 are hollow shafts 26, which are suitably separately formed from metal and connected to junction units 22 by means of screws or bolts or other securing means 25 as seen in FIG. 4 passing through appropriately aligned holes.

Connecting the two support members 12 and shafts 26 is an inverted U-shaped extension unit 27 defined by two vertical members 28, a horizonal member 30, and elbows 32. The vertical members 28 and the elbows 32 are hollow and can be formed as a unit, e.g. by molding, and the two elbows 32 are connected by the horizontal member 30 in any convenient manner, e.g. by means of screws 34, which are received in a corresponding openings (not shown) in horizontal member 30.

Suitably, vertical members 28 have an internal diameter greater than the external diameter of shafts 26 so that shafts 26 telescopically receive vertical members 28. Each of shafts 26 and members 28 are formed with apertures 36 into which a bolt or screw or like securing means (not shown) is received, (i.e., the bolt passes through the aperture at member 28, and and then into the aligned aperture of shaft 26 at which it can be threadingly received.) By providing a plurality of such apertures 36 in shafts 26, the height of U-shaped extension unit relatively to support members 12, and thus the height of horizontal member 30 relatively to the ground, can be readily adjusted. Shafts 26 can be longer than illustrated and can be provided with additional apertures to permit additional adjustability.

Disposed between the rear portions of support members 12 is a net 40, which is suitably secured at its lateral ends to support members 12, and the net 40 suitably has a height such that it extends between at least portions of vertical members 28, and is suitably secured to them, as by screws or bolts (not shown). The net serves as an effective back-stop for thrown, batted, or kicked balls, so that they will be contained within the playing area.

Figure 2:
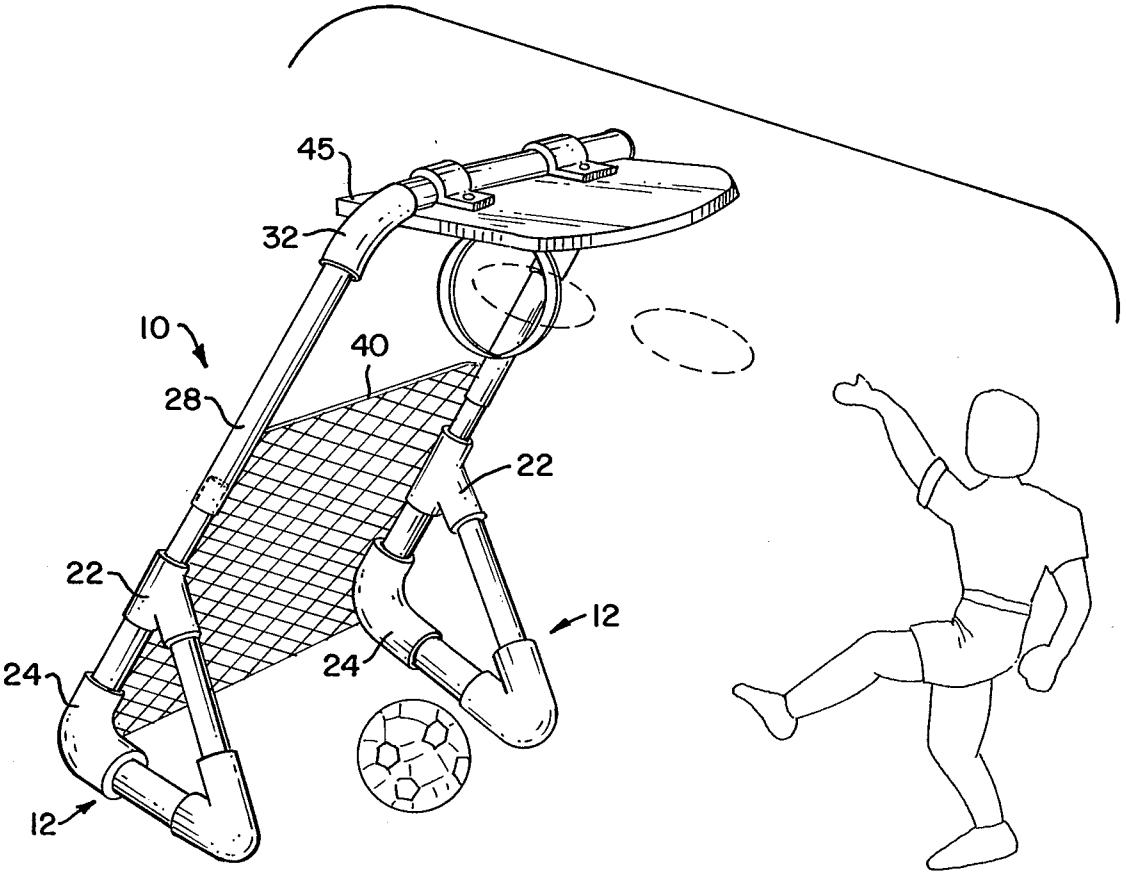
FIG. 2 is a diagrammatic perspective view similar to FIG. 1 but showing the backboard in horizontal position.

A principal feature of the apparatus of the invention is the adjustably rotatable backboard 45, which is rotatably mounted upon horizontal member 30, and can be positioned in the upright or vertical position as shown in FIG. 1 or, by simple adjustment, can be positioned horizontally as shown in FIG. 2. The backboard 45 can be formed from any convenient material, such as plastic, and is preferably hollow, to decrease weight.

Figure 3:
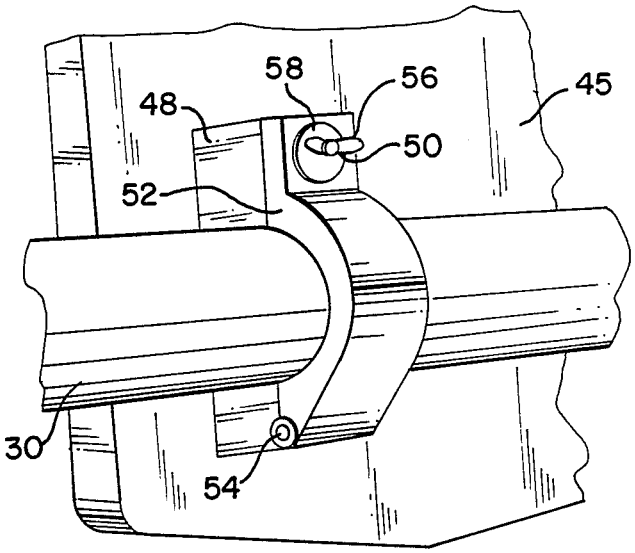
FIG. 3 is a detail perspective view, partially broken away, of a portion of the embodiment shown in FIG. 1, as seen from the rear.

For the purpose of mounting and adjusting the position of backboard 45 on horizontal member 30, there are provided blocks 48 attached to the rear of back-board 45. Each of blocks 48 is formed with a concave, contoured recess for smoothly receiving horizontal member 30, as seen FIG. 3. Each of the blocks 48 has extending from it the threaded end of a bolt 50, which is suitably embedded in the block. Cooperating with block 48 is an arm 52, which is hingedly connected at 54 to block 48, and is shaped to accommodate the arcuate surface of horizontal member 30. At its non-hinged end, the arm 52 is apertured (not shown) to receive bolt 50 and, for adjustably tightening arm 52 and block 48 around horizontal member 30, bolt 50 is provided a wing nut 56, which suitably cooperates with a washer 58. It will thus be seen that by loosening wing nut 56, the backboard 45 can be adjustably rotated about horizontal member 30, from a vertical position to a horizontal position, and held in either of these positions, or in any intermediate position, by tightening the nut 56 associated with each arm 52, and each block 48.

Referring now particularly to FIG. 1, the forward face of back-stop 45 is suitably provided with a basketball goal which is in the form of a ring or annular 55 attached to a supporting block 60, which in turn is attached in any convenient manner, as by bolts or screws, to backboard 45. The ring or annular member 55 of the basketball goal is provided on its inner surface with the usual hooks (not shown) by means of which can be hung the strands of a basketball goal net 64 or conventional form.

There is thus provided an apparatus for multiple sports activities, and for practicing and developing skills in several sports involving a ball or other sports projectile. For example, as previously mentioned, the net 40 stretchd between the support members 12 effectively serves as a back-stop for a thrown or batted baseball, whiffle ball, or a kicked soccer ball, or these parts serve as a goal for practicing soccer, lacrosse or hockey. At the same time, the backboard 45, with its goal 55, serves as a goal for practicing the shooting of basketballs when the back-board 45 is in its upright or vertical position, and the goal 55 extends horizontally. However, the backboard 45 can be rotated by 90°, either downwardly or upwardly into a horizontal position with the goal 55 extending vertically, either below or above the horizontal backboard, and the goal 55 can then effectively serve as a target for footballs or basketballs to practice throwing these sports projectiles. When so used, the net can be left in place to slow or stop the thrown ball or projectile; or the net can be removed as shown in Figure 2. Also the degree of rotation can be selected to meet an individual interest—i.e. an angle of greater or less than 90° can be set. As previously mentioned, the height of the backboard, and thus of the goal 55, can be readily adjusted by reason of the adjustable connection between the shafts 26 and vertical members 28, to increase or decrease the difficulty of using the goal 55 as a basketball goal or as a target, or to accommodate the growing size and/or experience of the child using the apparatus.

Even when the basketball goal 55 is not being used either as a goal or a target as described above, it is advantageous to rotate the backboard 45, and secure it with the goal 55 extending upwardly in order that there will be free access to the net 40 so that there will be no interference when the net 40 is used as a backstop for baseball, whiffle ball, soccer, hockey, or the like, or when it is used as a soccer, hockey, or lacrosse goal.

There is thus provided a single apparatus unit which can be used without the need for any interchangeable parts which have to be separately stored, and the convertible features of the apparatus make it possible to carry out a wide variety of sports activities. The apparatus is easily assembled, readily portable, and can be used in a field, or playground, or in the child's backyard at any time and, because of its versatility, it offers increased incentive for the child to increase his skills at several sports, as he chooses.

It will be obvious that various changes and modifications may be made without departing from the scope of the invention as defined in the impended claims, and is intended therefore, that all matter contained in the foregoing description and in the drawings shall be interpreted as illustrative only, and not in a limiting sense.

I claim:

1. A multi-purpose sports apparatus comprising a frame having spaced-apart support members adapted to rest upon a supporting surface, net means extending between the support members, a backboard and basketball goal hoop carried by said backboard, said backboard being supported between said support members above said net, and said backboard being adjustably rotatable horizontally between a vertical position and a horizontal position, whereby said basketball goal hoop can be positioned to extend horizontally or vertically.

2. A multi-purpose sports apparatus as defined in claim 1, wherein said frame includes a horizontal bar at its upper end and said backboard is adjustably rotatable about said bar.

3. A multi-purpose sports apparatus as defined in claim 1, wherein said frame is adjustable vertically to adjust the height of said backboard above the supporting surface.

4. A multi-purpose sports apparatus as defined in claim 1, wherein said support members carry means for vertically adjusting the height of said backboard.

5. A multi-purpose sports apparatus comprising a frame having spaced-apart members adapted to rest upon a supporting surface and a U-shaped upper portion, net means extending between the support members, a backboard carried by said U-shaped upper portion, a basketball goal hoop carried by said backboard, said backboard being adjustably rotatable horizontally between a vertical position and a horizontal position, whereby said backetball goal hoop can be positioned to extend horizontally or vertically.

6. A multi-purpose sports apparatus as defined in claim 5, wehrein said U-shaped upper portion includes a horizontal bar and said backboard is adjustably rotatable about said bar.

7. A multi-purpose sports apparatus as defined in claim 5, wherein said frame is adjustable vertically to adjust the height of said backboard above the supporting surface.

8. A multi-purpose sports apparatus as defined in claim 5, wherein said support members carry means for vertically adjusting the height of said backboard.

9. A multi-purpose sports apparatus comprising a frame having spaced-apart support members adapted to rest upon a supporting surface, a U-shaped upper portion, vertically adjustable tubular means between said supporting members and said upper portion for adjusting the height of said upper portion- to correct spelling and provide a proper function for the "means" expression, net means extending between the support members, a backboard carried by said u-shaped upper portion, a basketball goal hoop carried by said backboard, said back-board being supported between said support members above said net, and said backboard being adjustably rotatable horizontally between a vertical position and a horizontal position, whereby said basketball goal hoop can be positioned to extend horizontally or vertically.

10. A multi-purpose sports apparatus as defined in claim 9, wherein said U-shaped upper portion includes a horizontal bar at its upper end and said backboard is adjustably rotatable about said bar.

11. An apparatus as defined in claim 10, wherein said support members are hollow and adapted to be filled with sand or water.

12. Apparatus in accordance with claim 11, wherein said hollow members include enlarged boot portions at positions underlying the vertical plane of said vertical tubular means, to stabilize said apparatus.

* * * * *